US007882601B2

(12) United States Patent
Nguyen

(10) Patent No.: US 7,882,601 B2
(45) Date of Patent: Feb. 8, 2011

(54) SNAP CLIP LUG

(75) Inventor: Khanh Phu Nguyen, Wilsonville, OR (US)

(73) Assignee: Climax Molybdenum Company, Phoenix, AZ (US)

( * ) Notice: Subject to any disclaimer, the term of this patent is extended or adjusted under 35 U.S.C. 154(b) by 531 days.

(21) Appl. No.: 11/854,931

(22) Filed: Sep. 13, 2007

(65) Prior Publication Data

US 2009/0070973 A1 Mar. 19, 2009

(51) Int. Cl.
*A44B 11/25* (2006.01)

(52) U.S. Cl. ..... 24/265 BC; 24/615; 24/2.5

(58) Field of Classification Search ..... 24/265 R, 24/265 BC, 265 AL, 2.5, 614, 615
See application file for complete search history.

(56) References Cited

U.S. PATENT DOCUMENTS 5,067,267 A * 11/1991 Ives ..... 42/85
5,517,839 A * 5/1996 Parsons ..... 70/456 R
6,101,690 A * 8/2000 Giampavolo et al. ..... 24/598.2
6,178,600 B1 * 1/2001 French ..... 24/2.5
7,654,028 B1 * 2/2010 Grover ..... 42/85
2010/0199541 A1 * 8/2010 Vest et al. ..... 42/85

* cited by examiner

*Primary Examiner*—Robert J Sandy
*Assistant Examiner*—Michael Lee
(74) *Attorney, Agent, or Firm*—Fennemore Craig, P.C.

(57) ABSTRACT

A snap clip lug, including receptacle member, clasp member and a post. Receptacle member has a body including a sleeve, first post formation means connected to the body, and a locking slot disposed in relation to the sleeve. The sleeve includes a retaining wall and an opening at one end for receiving the clasp member. Clasp member has a base, second post formation means connected to the base, and a resilient arm extending outwardly from the base and having a locking tab for engaging the locking slot. The locking tab is adapted to slidingly engage the retaining wall and to be received by the locking slot. The post, which is disposed perpendicularly between the receptacle member and the clasp member, is formed from first and second post formation means having engaged one another when the resilient arm is inserted in the sleeve.

20 Claims, 8 Drawing Sheets

SNAP CLIP LUG

BACKGROUND

The present invention relates generally to fastener hardware, and more particularly to a snap clip lug.

Attachment lugs are typically used as a handle or support to which hooks or straps are connected to fasten two parts together. A lug typically includes a loop through which a strap may be threaded. A hook or other fastener alternatively may be clipped to the loop. A lug may be fixedly mounted to a device, or may be mounted in such a way as to allow the lug to swivel with respect to the device on which it is mounted. Often the lug is permanently closed. Others may be configured to allow opening of the lug. In some designs, a lug may be opened using a swivel mechanism. Lugs that open require more parts than permanently closed lugs. For example, a plunger type swivel lug is formed with seven different components and requires a user to unscrew a sleeve, then push a plunger and rotate an arm to open the lug. A need has developed for a simple lug, using few pieces, that is durable, as well as being easy and cost-effective to manufacture, assemble and utilize.

SUMMARY OF THE INVENTION

The following summary is provided as a brief overview of the claimed invention. It shall not limit the invention in any respect, with a detailed and fully enabling disclosure being set forth in the Detailed Description of the Invention section. Likewise, the invention shall not be restricted in any component, dimension, material, parameter, operating condition or other variable unless otherwise stated herein.

Snap clip lug of the present invention may comprise a receptacle member, the receptacle member comprising a body, first post formation means and a locking slot, the body being configured with a sleeve having a retaining wall and an opening at one end for receiving a clasp member, the locking slot being disposed in relation to the sleeve, and the post formation means being connected to the body; the clasp member, the clasp member comprising a base, second post formation means and a resilient arm, the resilient arm extending outwardly from the base and comprising a locking tab for engaging the locking slot, the locking tab being adapted to slidingly engage the retaining wall and to be received by the locking slot when the resilient arm is inserted into the opening of the sleeve, and the second post formation means being connected to the base; and a post, the post being disposed between the receptacle member and the clasp member and being formed from the first and second post formation means that engage one another when the resilient arm is inserted in the sleeve causing the locking tab to be received by the locking slot.

In another embodiment, the snap clip lug may comprise a receptacle member, the receptacle member comprising a body configured with a sleeve, the sleeve being defined by two retaining walls disposed in parallel located between an opening at one end of the sleeve and a locking slot at another end of the sleeve, the body having a shaft disposed in parallel to the sleeve; a clasp member, the clasp member comprising a base, the base having a recessed portion for receiving the shaft, and a resilient arm extending outwardly from the base, the resilient arm comprising a locking tab for engaging the locking slot, the locking tab comprising a guiding edge and a locking edge, the guiding edge being adapted to engage at least one retaining wall as the resilient arm is inserted into the opening of the sleeve and the locking edge being adapted to engage the locking slot, the resilient arm being adapted to flex in one direction as the resilient arm is inserted in the sleeve and in another direction as the locking edge engages the locking slot; and a post, the post being formed from the shaft being received by the recessed portion when the resilient arm is inserted in the sleeve and the locking edge engages the locking slot.

Yet another embodiment includes a method for assembling a snap clip lug, comprising inserting a resilient arm into an opening of a sleeve, the resilient arm being connected at one end to a base of a clasp member and comprising a locking tab operatively associated with another end of the resilient arm, the sleeve being defined in a receptacle member and having the opening at one end and a locking slot at another end; flexing the resilient arm in a first lateral direction during insertion in the opening; engaging the locking tab in the locking slot, thereby causing the resilient arm to flex in a second lateral direction, and; retaining the resilient arm in the sleeve, thereby forming the snap clip lug.

Still another embodiment of the present invention includes a method for disconnecting a snap clip lug, comprising supplying a snap clip lug, the snap clip lug comprising a clasp member and a receptacle member, the clasp member having a resilient arm connected to a locking tab, the receptacle member having a sleeve, the sleeve having a locking slot at one end, the resilient arm fitting into the sleeve such that the locking tab engages the locking slot thereby retaining the resilient arm in the sleeve; flexing the resilient arm in a lateral direction; disengaging the locking tab from the locking slot; and separating the clasp member from the receptacle member.

BRIEF DESCRIPTION OF THE DRAWINGS

The accompanying figures, which are incorporated herein and form a part of the specification, illustrate various embodiments of the present invention and together with the description serve to explain the invention. In the figures.

DETAILED DESCRIPTION OF THE INVENTION

A quick disconnect snap clip lug 10 of the present invention comprises separable cooperating receptacle member 20 and clasp member 40. The receptacle member 20 and the clasp member 40 each include cooperating, coupling or locking means for releasably coupling clasp member 20 and receptacle member 40.

Figure 1:
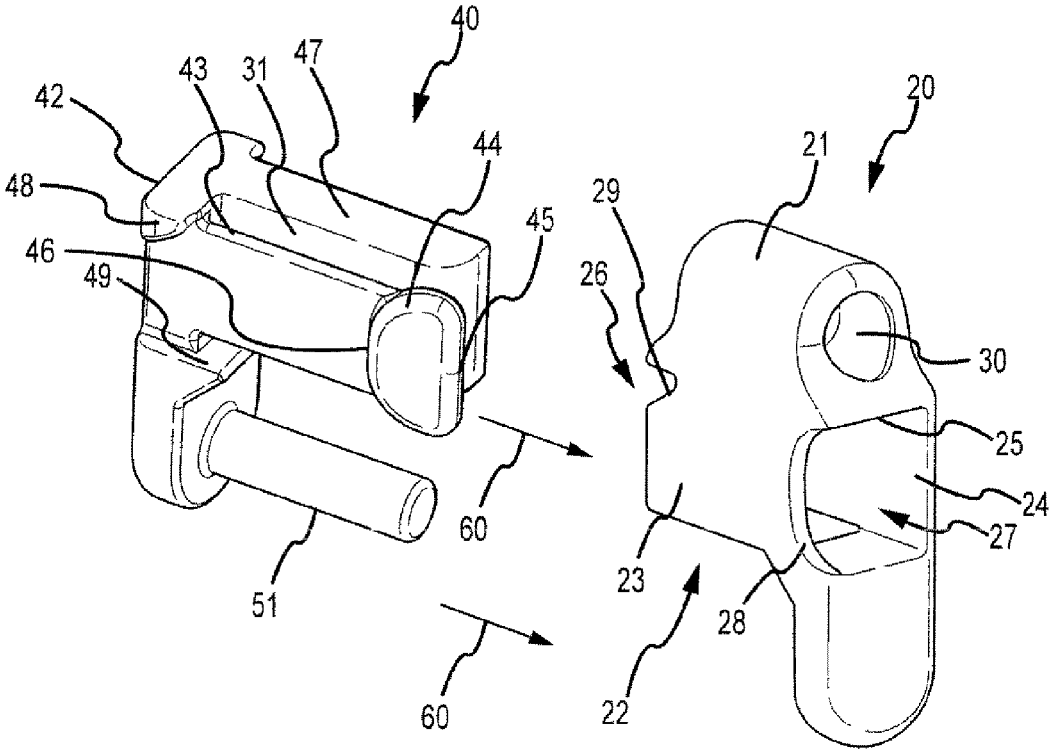
FIG. 1 shows a perspective view of separated cooperating components of a snap clip lug according to the present invention.
Figure 6A:
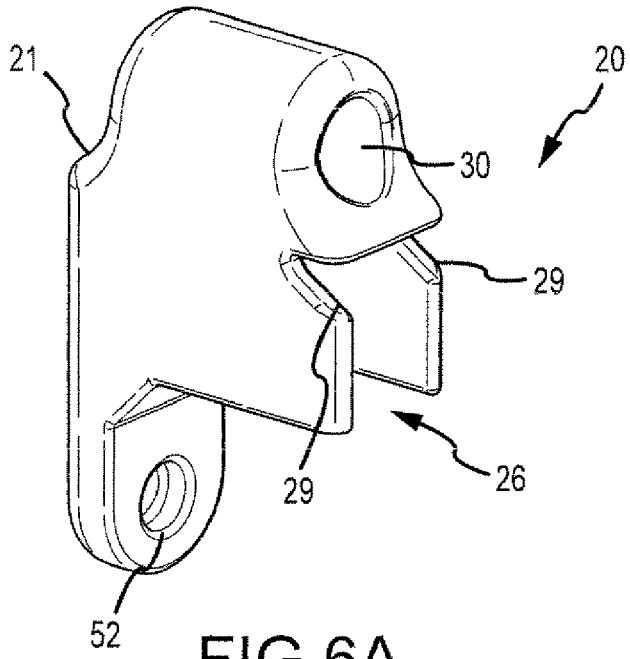
FIG. 6 shows two views of a receptacle member.
Figure 6B:
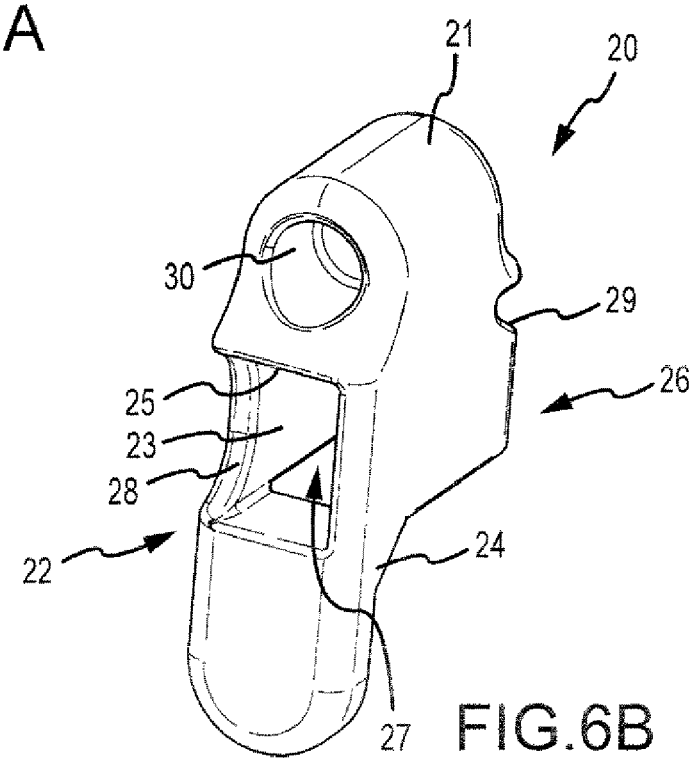

As shown in FIG. 11 receptacle member 20 comprises a hollow sleeve portion, or sleeve 22, having first and second retaining walls 23, 24 and top retaining wall 25. Sleeve 22 further comprises opening 26 at one end (into which clasp member 40 may be inserted) and locking slot 27 at the other end. The locking or coupling means of receptacle member 20 includes locking slot 27. As shown in FIGS. 1 and 6, the locking slot 27 may face opposite opening 26. In another embodiment, the locking slot 27 may be formed in one of the retaining walls 23, 24, 25. At least one edge of locking slot 27 forms a retaining ridge 28.

FIG. 1 also illustrates clasp member 40 of snap clip lug 10. Clasp member 40 comprises a base 42 having a resilient arm 43 and a guiding stop 47, both of which may be integrally attached to and extend outwardly from base 42 in the same direction. In the embodiment shown in FIG. 1, resilient arm 43 and guiding stop 47 are perpendicular to the base 42. Resilient arm 43 and guiding stop 47 are spaced apart, disposed in parallel, forming a gap 31 between them. Gap 31 allows the resilient arm 43 to flex laterally, as will be discussed in more detail below. In addition, the gap 31 may be sized to cause the total outer span of the resilient arm 43, gap 31 and guiding stop 47 to be substantially the same width as the space defined by the first and second retaining walls 23, 24 on the inside of the sleeve 22. The resilient arm 43 is configured with locking tab 44 comprising a raised guiding edge 45 and a raised locking edge 46. The guiding edge 45 may be formed at the leading edge of the resilient arm 43. The locking edge 46 may be formed on a non-leading edge. The total outer span of the locking tab 44 of the resilient arm 43 (at its widest point), gap 31 and guiding stop 47 exceeds the width of opening 26. The guiding edge 45 of the locking tab 44 may decrease in width towards the leading edge thereof to define a ramp or curve thereon. The total outer span of the locking tab 44 of the resilient arm 43 (at its narrowest point which may be the leading edge of guiding edge 45), gap 31 and guiding stop 47 may be slightly less than the width of opening 26. The lengths of the resilient arm 43 (including the locking tab 44) and the guiding stop 47 are substantially equal to the length of sleeve 22.

Figure 5A:
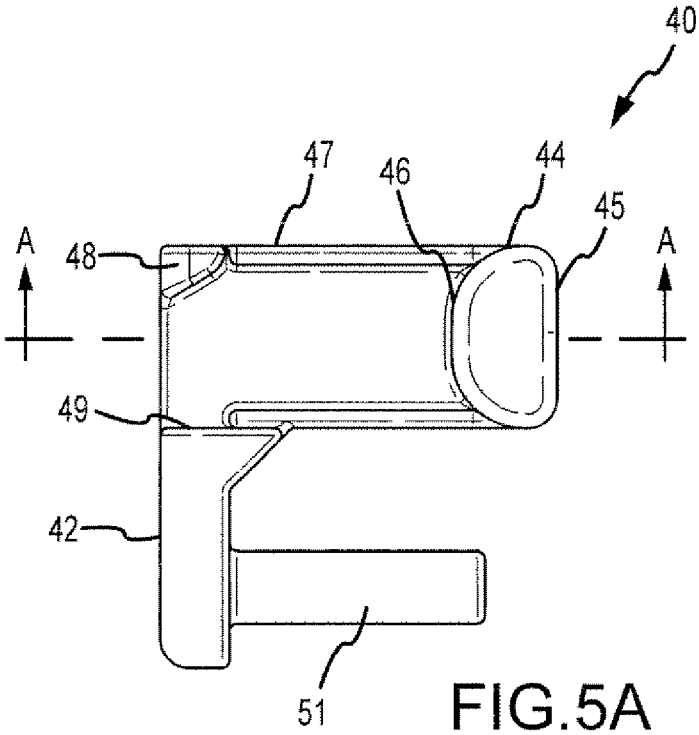
FIG. 5 shows two views of the clasp member, FIG. 5(B) showing a cross-sectional view, taken generally along the line A-A', of the clasp member of FIG. 5(A)
Figure 5B:
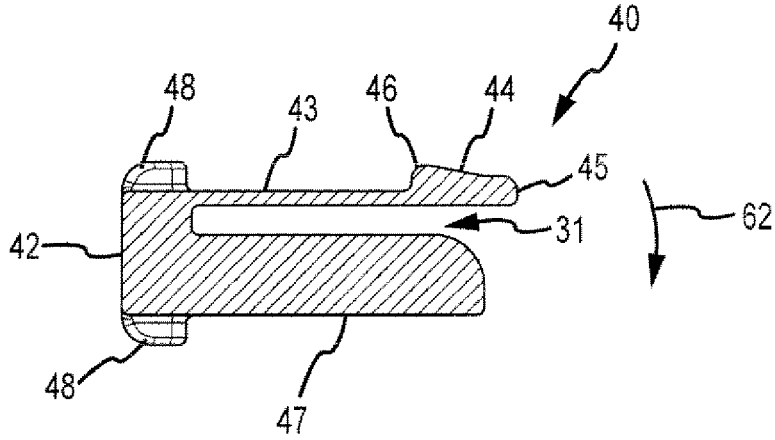

According to the present invention, clasp member 40 may be readily inserted into opening 26 of receptacle member 20. More specifically, the leading edge of guiding edge 45 (of locking tab 44 of resilient arm 43) slidingly engages the inner sides of the first and second retaining walls 23, 24 and top retaining wall 25. The resilient arm 43 is adapted to flex laterally (e.g., toward guiding stop 47) as clasp member 40 is inserted into the receptacle member 20 (in the direction indicated by arrow 60 in FIG. 1). Thus, resilient arm 43 flexes laterally from a non-flexed position to a flexed position. In this regard, the resilient arm 43 flexes toward the guiding stop 47 in the direction of the arrow 62 shown in FIG. 5(B). As the trailing end of locking tab 44 reaches the locking slot 27, resilient arm 43 springs or snaps back to its original non-flexed position, such that the locking tab 44 clips into seated, locked engagement with the locking slot 27 of receptacle 20. The retaining ridge 28 of opening 26 thus engages locking edge 46 of locking tab 44 to lock locking tab 44 within locking slot 27 thereby preventing movement or removal of clasp member 40 (in a direction opposite arrows 60). Guiding stop 47 may be configured to engage at least one of the retaining walls 23, 24, 25 when the locking tab 44 is locked in the locking slot 27 so as to prevent motion of the clasp member 40 about the axis of sleeve 22.

Figure 2:
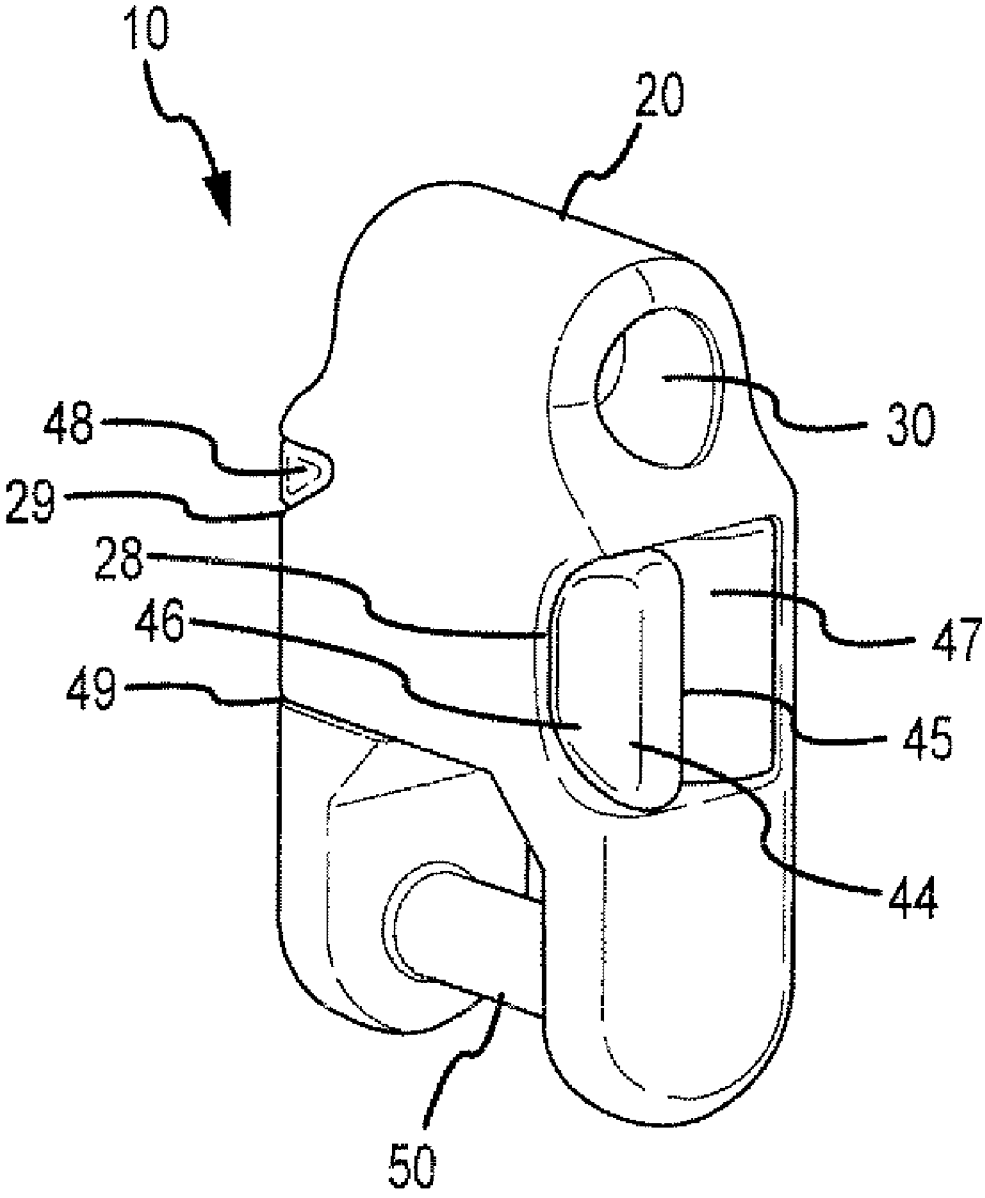
FIG. 2 shows a perspective view of the snap clip lug assembled in accordance with this invention.

As shown in FIGS. 1, 2 and 6, the inner cross-sectional shape of the sleeve 22 substantially conforms to the cross-sectional shape of the outer edges of the combination of the resilient arm 43, gap 31 and guiding stop 47. Sleeve 22 is adapted for simultaneously slidingly engaging resilient arm 43 and guiding stop 47, thereby defining cooperating guide means for guiding clasp member 40 into receptacle member 20. The cooperation between retaining wails 23, 24, 25, resilient arm 43 and guiding stop 47 substantially limits the relative motion between the clasp member 40 and receptacle member 20 upon either insertion or removal of the clasp member 40 along the plane defined by arrows 60 of FIG. 1.

Base 42 of clasp member 40 comprises a stop 48 that protrudes from base 42. Stop 48 generally exceeds the dimensions of opening 26 to define the limit of insertion when clasp member 40 is inserted into receptacle member 20 (in the direction indicated by arrows 60 in FIG. 1). The limit of insertion corresponds generally to the point at which locking tab 44 engages locking slot 27 as shown in FIG. 2. In one embodiment, stop 48 is a ridge of predefined shape. As shown in FIGS. 1-3 and 6, receptacle member 20 includes guiding stop seat 29 that is shaped to substantially conform to the predefined shape of the stop 48. As resilient arm 43 and guiding stop 47 near the limit of insertion, stop 48 slidingly engages guiding stop seat 29. When locking tab 44 snaps into locked position within locking slot 27, stop 48 of clasp member 40 is fully seated on or within guiding stop seat 29 of receptacle member 20.

In any of the embodiments previously described, clasp member 40 may be further configured with a second stop, clasp member stop 49, sized to engage the receptacle member 20 when the clasp member 40 is locked into the receptacle member 20 in the assembled, closed position. As shown in FIGS. 1-4, clasp member stop 49 engages the lower edge of retaining walls 23, 24, thereby preventing clasp member 40 from moving in a direction perpendicular to the axis of post 50.

When assembled, receptacle member 20 and clasp member 40 together form post 50, as illustrated in FIG. 2. In one embodiment, the clasp member 40 comprises shaft 51 having a proximal end and a distal end. The proximal end of shaft 51 may be integrally attached to and extend outwardly from the base 42 (e.g., in perpendicular fashion). In this embodiment, body 21 of the receptacle member 20 includes a shaft engaging portion 52 (as best seen in FIG. 6A) that engages the distal end of shaft 51 when the clasp member 40 is coupled with, and locked into, the receptacle member 20 as described above. As the locking tab 44 of the resilient arm 43 begins to slidingly engage the locking slot 27, the shaft 51 begins to engage shaft engaging portion 52 of the receptacle member 20. Shaft 51 becomes fully seated within the shaft engaging portion 52 of the receptacle member 20 when the locking tab 44 snaps into the locked or closed position (wherein locking edge 46 is retained by the retaining ridge 28 of the locking slot 27). In the closed position, illustrated in FIGS. 2 and 3, the receptacle member 20 and clasp member 40 cooperate to form snap clip lug 10.

In other embodiments, components may be relocated from clasp member 40 to receptacle member 20 and vice versa in any manner that would allow the clasp member 40 and receptacle member 20 to cooperate with each other to form snap clip lug 10 in accordance with the teachings herein.

Thus, in an alternative embodiment (not shown), shaft 51 may be integrally attached to receptacle member 20. In that case, shaft 51 extends outwardly from the body 21 of receptacle member 20 in a perpendicular fashion. Shaft engaging portion 52 would then be relocated to clasp member 40 for engaging the distal end of shaft 51 when the clasp member 40 is locked into the receptacle member 20 as described above. As locking tab 44 of the resilient arm 43 begins to slidingly engage the locking slot 27, the shaft 51 begins to engage the shaft engaging portion 52 of clasp member 40, and becomes fully seated within the shaft engaging portion 52 when the locking tab 44 snaps into the closed position (wherein the locking edge 46 is retained by the retaining ridge 28 of the locking slot 27).

In another alternative embodiment (not shown), receptacle member 20 comprises a first partial shaft having a proximal end and a distal end. The proximal end of the receptacle member's 20 first partial shaft may be integrally attached to and extend outwardly from body 21 (e.g., in a perpendicular fashion). The distal end of the first partial shaft is configured with a first keyed portion. In this embodiment, clasp member 40 comprises a second partial shaft having a proximal end and a distal end. The proximal end of the second partial shaft may be integrally attached to and extend outwardly from the base 42 (e.g., in a perpendicular fashion). The distal end of the second partial shaft is configured with a second keyed portion that mates with the first keyed portion of the receptacle member's 20 first partial shaft when the clasp member 40 is locked into the receptacle member 20 as described above. As the locking tab 44 of resilient arm 43 begins to slidingly engage the locking slot 27, the second keyed portion of the clasp member's 40 second partial shaft begins to engage the first keyed portion of the receptacle member's first partial shaft. The second partial shaft and the first partial shaft become fully mated to form post 50 disposed between clasp member 40 and receptacle member 20 when the locking tab 44 snaps into the closed position (wherein the locking edge portion 46 is retained by the retaining ridge 28 of the locking slot 27).

Figure 3:
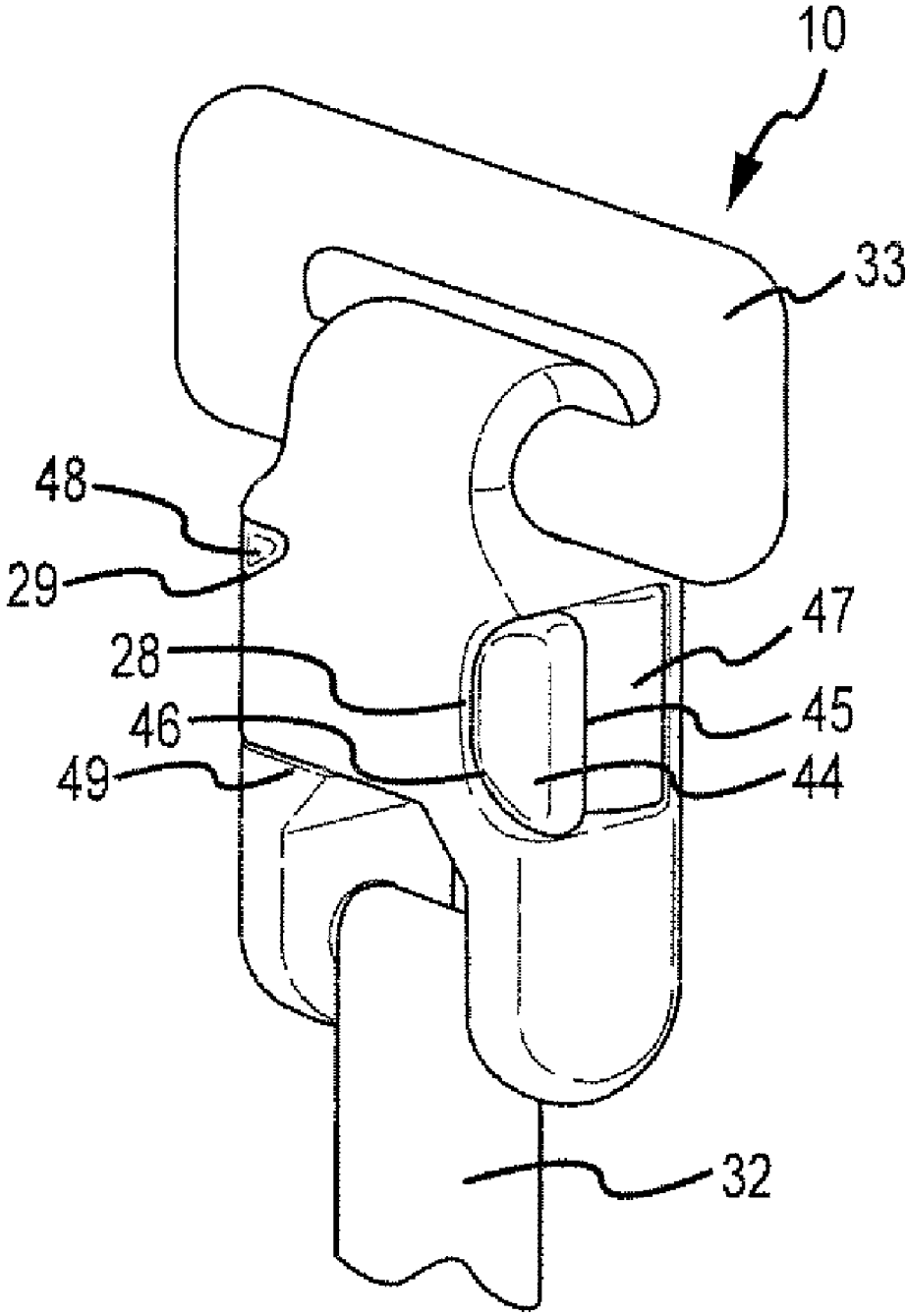
FIG. 3 shows a perspective view of the assembled snap clip lug of FIG. 2, mounted to a device and with an attachment strap.
Figure 4A:
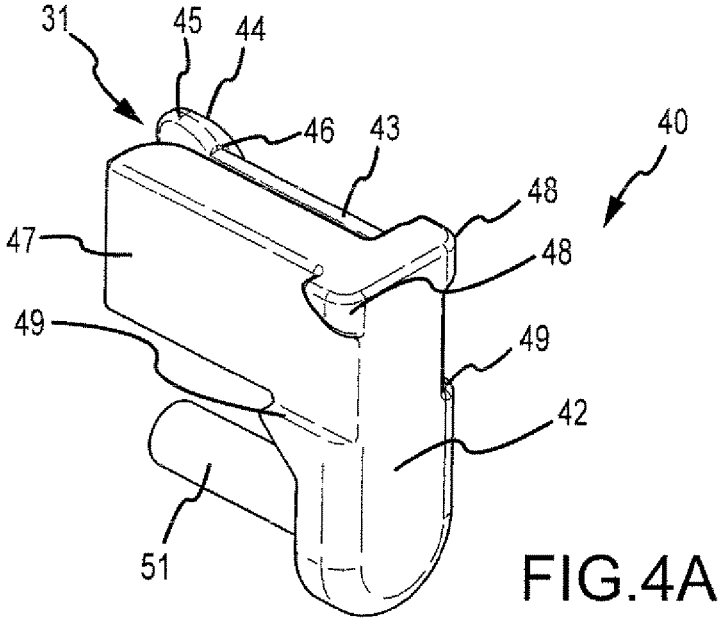
FIG. 4 shows two views of a clasp member.
Figure 4B:
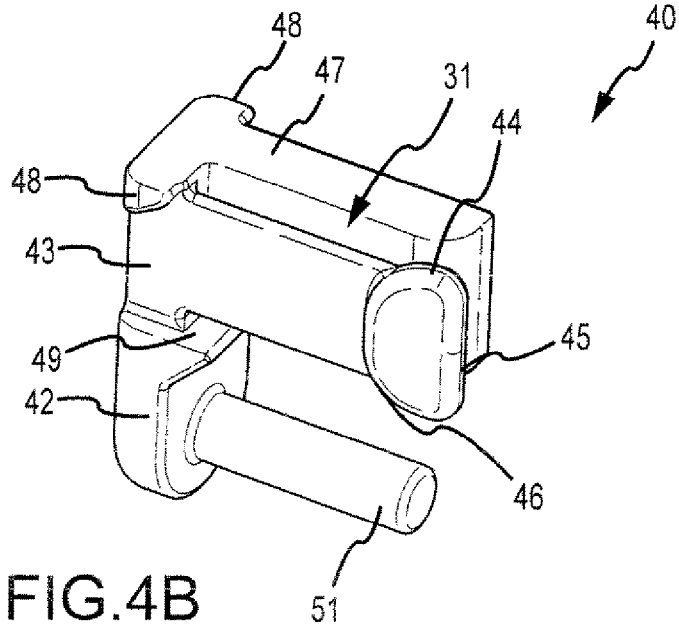
Figure 7:
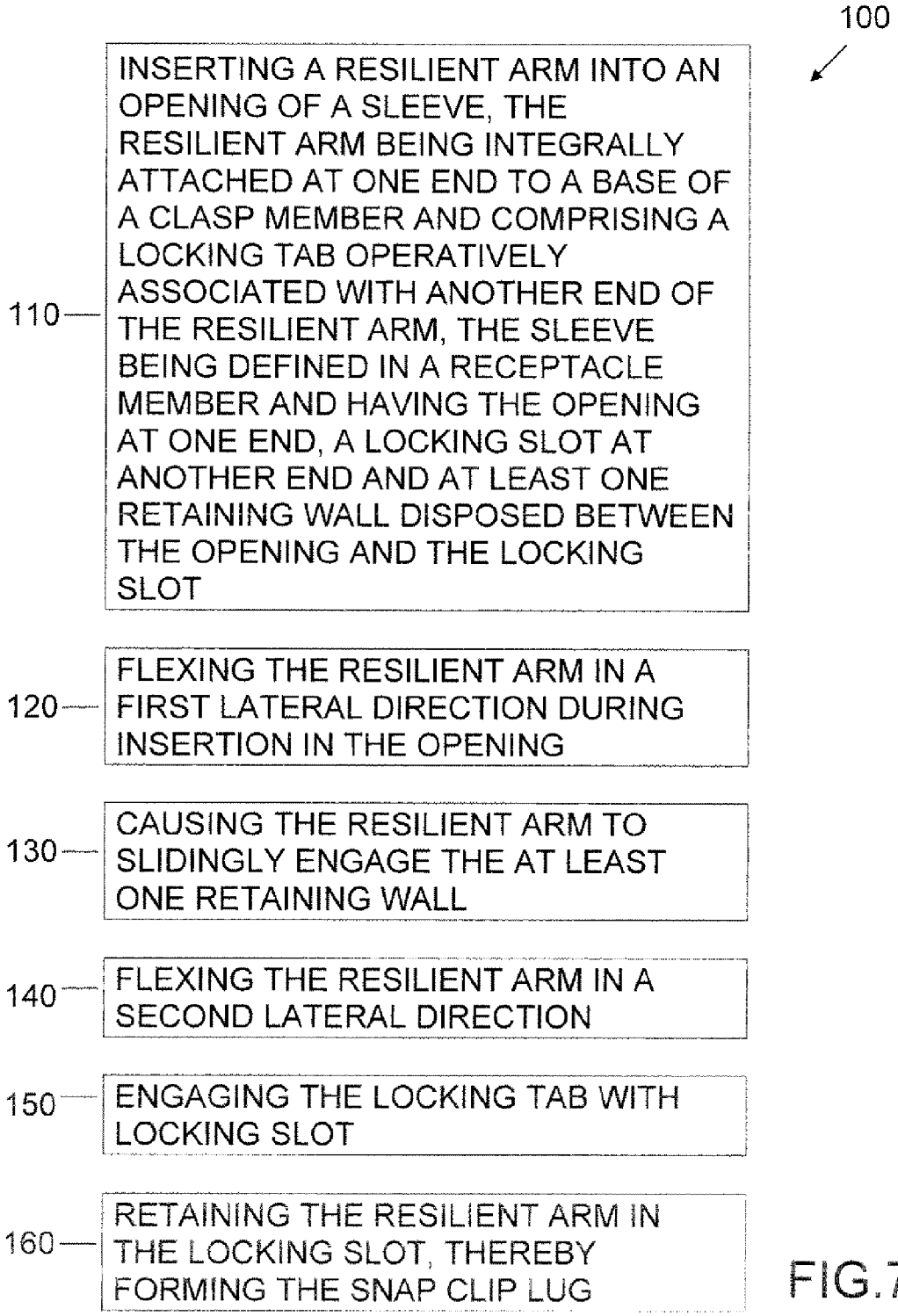
FIG. 7 shows a method for assembling the snap clip lug according to the present invention.

Next will be described a method 100 for assembling snap clip lug 10 components to form the snap clip lug 10 illustrated in FIGS. 1-3. As illustrated in FIG. 7, the method 100 for assembling snap clip lug 10 may comprise providing two cooperating members, such as clasp member 40 and receptacle member 20. As has been previously described, clasp member 40 comprises resilient arm 43 attached to locking tab 44. Receptacle member 20 comprises sleeve 22 that has locking slot 27 at one end. Method 100 may further comprise inserting 111 resilient arm 43 into opening 26 of sleeve 22, resilient arm 43 being integrally attached at one end to base 42 and having locking tab 44 at its other end. Method 100 may further comprise flexing 120 the resilient arm 43 in the lateral direction during insertion in the opening 26. As described in an embodiment herein, flexing 120 the resilient arm may comprise flexing the resilient arm laterally toward the guide stop 47. As the resilient arm 43 is inserted 110 and flexed 120, the method 100 further comprises causing 130 resilient arm 43 to slidingly engage at least one of retaining walls 23, 24, 25. As the trailing end of locking tab 44 reaches locking slot 47, the method 100 may comprise returning resilient arm 34 to its original unflexed position by flexing 140 it in a direction opposite to the lateral direction. As the resilient arm 43 snaps back into its unflexed position, the method 100 may further comprise retaining 150 the resilient arm 43 in the locking slot 47 by engaging locking edge 46 of locking tab 44 with locking slot 27, thereby forming snap clip lug 10. Method 100 may further comprise causing the shaft 51 to be engaged by the shaft engagement portion 52, forming post 50.

Once snap clip lug 10 has been assembled as described herein, snap clip lug 10 may be mounted to a device, implement or part (not shown) using mounting lug 30. In one embodiment, mounting lug 30 may be a slot in the body 21 of receptacle member 20, which is shown in FIGS. 1-3 as being parallel to the axis of sleeve 22. Mounting lug 30 may be used to affix snap clip lug 10 to another implement by way of mounting device 33, which may be a bolt, a stud, a strap, a cord or the like. As shown in FIG. 3 mounting device 33 may be looped through mounting lug 30. In addition, an attachment strap 32 or other similar device may be looped around post 50 so that attachment strap 32 can be used to carry or use the implement to which snap clip lug 10 is attached via mounting device 33.

Figure 8:
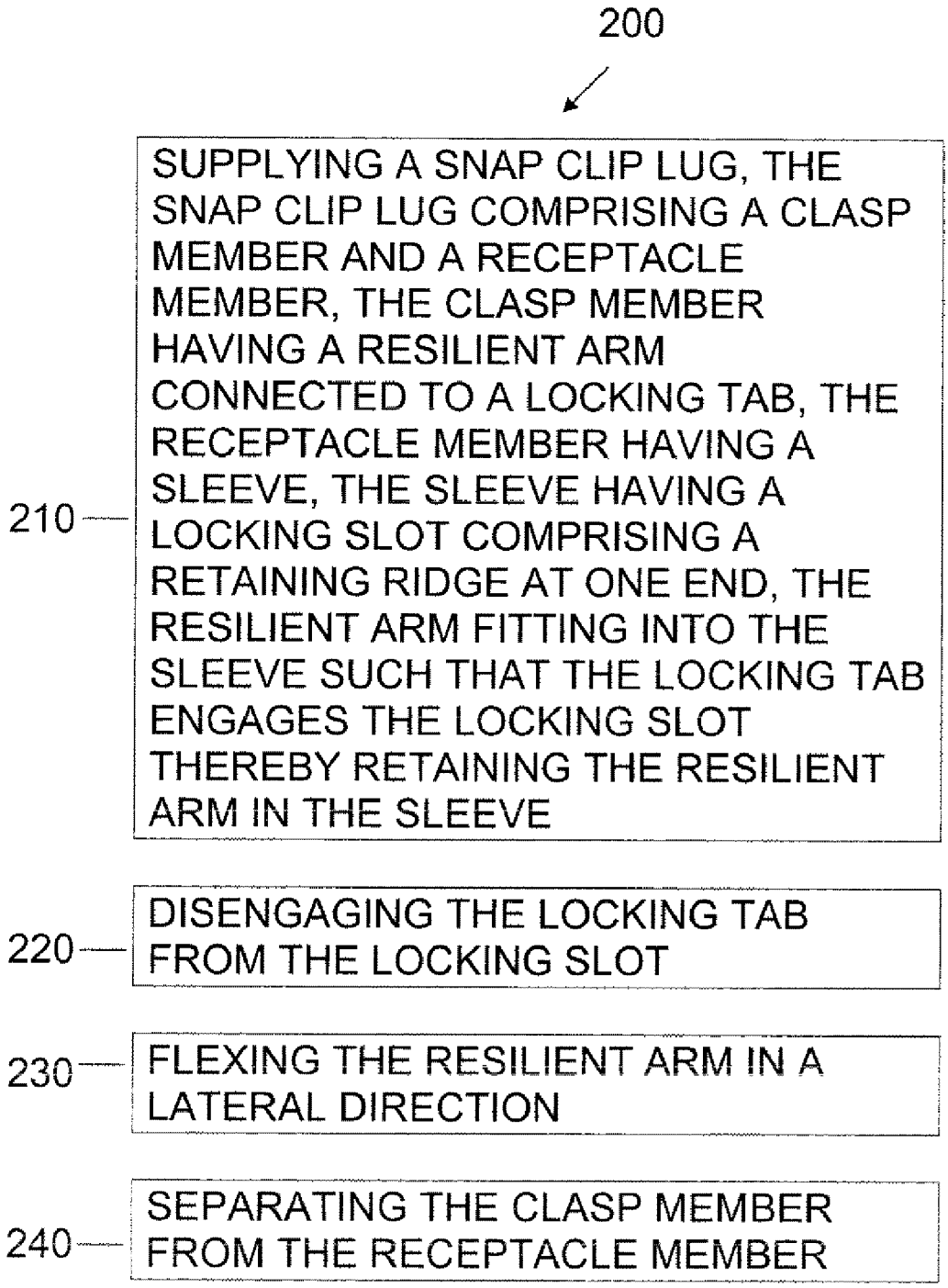
FIG. 8 shows a method for disassembling the snap clip lug according to the present invention.

FIG. 8 illustrates a method 200 for disassembling or opening snap clip lug 10. The method 200 comprises supplying 210 snap clip lug 10, the snap clip lug 10 comprising clasp member 40 and receptacle member 20. As has been previously described, clasp member 40 comprises resilient arm 43 attached to locking tab 44. Receptacle member 20 comprises sleeve 22 that has locking slot 27 at one end. Snap clip lug 10 having been previously assembled according to an embodiment of method 100, the resilient arm 43 has been fitted into the sleeve 22 such that the locking tab 44 has engaged the locking slot 27, retaining the resilient arm 43 in the sleeve 22. Thus, the method 200 generally comprises sliding the resilient arm 43 in a direction away from locking slot 27 to separate the clasp member 40 from the receptacle member 20, which involves disengaging 220 the locking tab 44 from locking slot 27 to remove clasp member 40 from receptacle member 20. The method 200 further comprises flexing 230 the resilient arm 43 in a lateral direction. In one embodiment described herein, the resilient arm 43 is flexed 230 laterally toward guide stop 47. The flexing 230 causes the locking edge 46 to be separated from the retaining ridge 28 of the locking slot 27, thereby causing the locking tab 44 to be disengaged 220 from the locking slot 27. With the locking edge 46 disengaged from the retaining ridge 28, the resilient arm 43 continues to be flexed 230 laterally (e.g., toward guiding stop 47), reducing the size of gap 31 such that the total outer span occupied by resilient arm 43 (including locking tab 44), gap 31 and guiding stop 47 is less than the distance between the retaining walls 23, 24 of sleeve 22. The method 200 further comprises separating 240 clasp member 40 from receptacle member 20 by, in this case, moving (e.g., sliding) the resilient arm 43 in a direction opposite to that shown by arrows 60 in FIG. 1 (e.g., away from and perpendicular to the locking slot 27). Once clasp member 40 has been separated from receptacle member 20, post 50 will also open (e.g., separate into shaft 51 and shaft engagement portion 52). Therefore, method 200 may further comprise removing attachment strap 32.

Clasp member 40 and receptacle member 20 may preferably be formed of metal using metal injection molding techniques. Molds of each of the clasp member 40 and receptacle 20, including all of the aforementioned features such as the resilient arm 43, guide stop 47, shaft 51, sleeve 22, mounting lug 30, etc., are designed and built. In metal injection molding, liquid metal is injected into the molds to fill the cavities of the mold. The mold is then cooled, opened, and the parts ejected. Any excess flashing (unwanted metal such as the metal remaining in the injection tunnel of the mold through which the liquid metal travels between entry of the mold and the mold cavity) is removed, and the receptacle member 20 and/or clasp member 40 are ready for use. Other techniques for metal injection molding may also be used as would be familiar to one of ordinary skill in the art. Using metal injection molded parts provides for snap clip lug 10 that is durable, as well as being easy and cost-effective to manufactures assemble and use because it uses a limited number of components (e.g., two). In addition, the manner in which clasp member 40 and receptacle member 20 cooperate when assembled provides an element of safety by securing the snap clip lug 10 in a closed position until disassembled according to method 200. Snap clip lug 10 has particular utility in military, law enforcement and field applications where durability, safety, and easy utilization are desired.

Alternatively, clasp member 40 and receptacle member 20, may be formed of plastics, composites and other materials suitable for molding as would be familiar to one of ordinary skill in the art after becoming familiar with the teachings of this invention.

Having herein set forth preferred embodiments of the present invention, it is anticipated that suitable modifications can be made thereto which will nonetheless remain within the scope of the invention. The invention shall therefore only be construed in accordance with the following claims:

The invention claimed is:

1. A snap clip lug, comprising:

a receptacle member, the receptacle member comprising a body, first post formation means and a locking slot, the body being configured with a sleeve having a retaining wall and an opening at one end for receiving a clasp member, the locking slot being disposed in relation to the sleeve, the first post formation means being connected to the body;

the clasp member, the clasp member comprising a base, second post formation means and a resilient arm, the resilient arm extending outwardly from the base and comprising a locking tab for engaging the locking slot, the locking tab being adapted to slidingly engage the retaining wall and to be received by the locking slot when the resilient arm is inserted into the opening of the sleeve, the second post formation means being connected to the base; and a post, the post being disposed between the receptacle member and the clasp member and being formed from the first and second post formation means that engage one another when the resilient arm is inserted in the sleeve causing the locking tab to be received by the locking slot.

2. The snap clip lug of claim 1, wherein the locking tab comprises a guiding edge and a locking edge.

3. The snap clip lug of claim 2, wherein the guiding edge is adapted to slidingly engage the retaining wall and the locking edge is adapted to be received by and locked into the locking slot when the resilient arm is inserted fully into the opening of the sleeve.

4. The snap clip lug of claim 3, wherein the locking slot comprises at least one edge configured as a retaining ridge to engage the locking edge.

5. The snap clip lug of claim 3, wherein the retaining wall of the sleeve is configured to substantially limit relative motion between the clasp member and receptacle member when the locking edge is received by and locked into the locking slot.

6. The snap clip lug of claim 1, wherein the resilient arm is adapted-to flex from a non-flexed position to a flexed position as the resilient arm is inserted into the sleeve and to return to the non-flexed position as the locking tab is received by the locking slot.

7. The snap clip lug of claim 1, wherein the locking slot being disposed in relation to the sleeve comprises a position facing opposite the opening in the sleeve.

8. The snap clip lug of claim 1, wherein the clasp member comprises a guiding stop, the guiding stop extending outwardly from the base, being disposed substantially in parallel with the resilient arm, and being adapted to engage the locking slot when the resilient arm is inserted into the opening of the sleeve.

9. The snap clip lug of claim 8, wherein the guiding stop and the resilient arm define a gap therebetween, the gap causing the guiding stop and the resilient arm to substantially occupy a space defined by the sleeve when the resilient arm is inserted into the sleeve.

10. The snap clip lug of claim 1, wherein the receptacle member comprises means for attachment to a mounting device.

11. The snap clip lug of claim 10, wherein the means for attachment comprise a slot.

12. The snap clip lug of claim 1, wherein the receptacle member comprises means for retaining the locking tab in the locking slot.

13. The snap clip lug of claim 1, wherein the second post formation means comprise a shaft, the shaft extending outwardly from the base, and the first post formation means comprise a shaft engagement portion for engaging the shaft when the resilient arm is inserted into the sleeve.

14. The snap clip lug of claim 13, wherein the shaft engagement portion comprises a recess in the receptacle member.

15. The snap clip lug of claim 1, wherein the first post formation means comprise a shaft, the shaft extending outwardly from the body and being disposed in parallel with the sleeve, and the second post formation means comprise a shaft engagement portion for engaging the shaft when the resilient arm is inserted into the sleeve.

16. The snap clip lug of claim 15, wherein the shaft engagement portion comprises a recess in the clasp member.

17. A snap clip lug, comprising:

a receptacle member, the receptacle member comprising a body configured with a sleeve, the sleeve being defined by two retaining walls disposed in parallel between an opening at one end of the sleeve and a locking slot at another end of the sleeve, the body having a shaft disposed in parallel to the sleeve;

a clasp member, the clasp member comprising a base, the base having a recessed portion for receiving the shaft, and a resilient arm extending outwardly from the base, the resilient arm comprising a locking tab for engaging the locking slot, the locking tab comprising a guiding edge and a locking edge, the guiding edge being adapted to engage at least one retaining wall as the resilient arm is inserted into the opening of the sleeve and the locking edge being adapted to engage the locking slot, the resilient arm being adapted to flex in one direction as the resilient arm is inserted in the sleeve and in another direction as the locking edge engages the locking slot; and a post, the post being formed from the shaft being received by the recessed portion when the resilient arm is inserted in the sleeve and the locking edge engages the locking slot.

18. The snap clip lug of claim 17, wherein the clasp member comprises a guiding stop.

19. The snap clip lug of claim 18, wherein the guiding stop extends outwardly from the base member in a same direction as the resilient arm, the resilient arm and the guiding stop being in spaced apart relation such that an outer span of the resilient arm and the guiding stop is substantially a distance between the two retaining walls.

20. The snap clip lug of claim 17, wherein the receptacle member comprises means for attaching a mounting mechanism.

* * * * *